United States Patent [19]

Suzuki et al.

[11] 4,100,722

[45] Jul. 18, 1978

[54] METHOD OF AUTOMATICALLY PIECING UP A YARN IN AN OPEN-END SPINNING MACHINE AND AN OPEN-END SPINNING MACHINE FOR CARRYING OUT THE SAME

[75] Inventors: Osamu Suzuki, Obu; Shozo Ueda, Kariya; Ichiro Tashiro, Nagoya, all of Japan

[73] Assignee: Kabushiki Kaisha Toyoda Jidoshokki Seisakusho, Japan

[21] Appl. No.: 788,126

[22] Filed: Apr. 18, 1977

[51] Int. Cl.[2] ..... D01H 13/04; D01H 15/00

[52] U.S. Cl. ..... 57/34 R; 57/58.89; 57/80; 57/159

[58] Field of Search ..... 57/34 R, 58.89–58.95, 57/78, 80, 81, 106, 110, 156, 22, 159

[56] References Cited

U.S. PATENT DOCUMENTS

| | | | |
|---|---|---|---|
| 3,354,626 | 11/1967 | Cizek et al. | 57/78 |
| 3,541,774 | 11/1970 | Sterba et al. | 57/81 X |
| 3,670,484 | 6/1972 | Brazda et al. | 57/58.89 X |
| 3,695,017 | 10/1972 | Hori et al. | 57/81 X |
| 3,733,799 | 5/1973 | Roethke | 57/81 X |
| 3,939,638 | 2/1976 | Bruckert et al. | 57/58.89 X |
| 4,020,622 | 5/1977 | Lattion | 57/58.89 X |

*Primary Examiner*—Donald Watkins

*Attorney, Agent, or Firm*—Burgess, Ryan and Wayne

[57] ABSTRACT

A method of automatically piecing up a yarn in an open-end spinning machine by rotating the draw off rollers and winding drum in a direction opposite to their normal rotating directions; rotating the feed rollers according to a predetermined program so that the feed rollers begin to rotate after an end of the yarn is moved back into the spinning rotor where the moved back yarn is pieced up with the newly spun yarn; rotating both the draw off rollers and the winding drum in their normal rotating direction, and starting the traverse motion of the traverse guide, which takes place after the pieced joint reaches a contacting line formed between the winding drum and the cheese.

By utilizing this method and machine, the number of yarn breakages occuring during starting operation is decreased.

5 Claims, 3 Drawing Figures

METHOD OF AUTOMATICALLY PIECING UP A YARN IN AN OPEN-END SPINNING MACHINE AND AN OPEN-END SPINNING MACHINE FOR CARRYING OUT THE SAME

SUMMARY OF THE INVENTION

The present invention relates to a controlling method of automatically piecing up a yarn in an open-end spinning machine, and to an open-end spinning machine for carrying out the same.

In practical mill operations the open-end spinning machines are usually stopped during non-operating hours of the mill, in addition, in some cases, an open-end spinning machine is stopped when a yarn breakage is detected so as to repair the broken yarn. In such cases, it is required that the open-end spinning machine be easily restarted.

To facilitate easy restarting of an open-end spinning machine, many stopping methods of the same have been proposed. For example, a usual method for stopping a conventional open-end spinning machine is to first stop the supply of fibers to the spinning motor, which collects the fibers into a yarn. Then, after a predetermined time has passed, the rotation of the draw off rollers, which withdraw the yarn from the spinning rotor, and the winding drum which frictionally rotates the bobbin, and the traverse motion of the traverse guide, which traverses the yarn along the bobbin, are stopped. When the machine is started again, the draw off rollers and the winding drum are first rotated in the direction opposite to the normal rotating direction thereof. This allows the yarn wound around the bobbin to be unwound and the end of the yarn situated in a delivery tube connected to the spinning rotor to be sent back into the spinning rotor.

At the same time fibers are supplied into the spinning rotor by a combing roller so as to facilitate the piecing up of the yarn. After a predetermined time has passed, the draw off rollers and the winding drum are rotated in the normal direction, and the traverse of the traverse guide is simultaneously started, so that the winding of the yarn is commenced.

However, in the above described method, the traversing of the pieced joint between the end of the yarn and the newly spun yarn is commenced by the traverse guide before it is wound around the cheese. This generates a certain tension in the yarn having the pieced joint, which has a low yarn strength, and frequent yarn breakages may occur. Each such yarn breakage is considered a failure of an automatic piecing up operation in an open-end spinning machine.

An object of the present invention is to provide a method of automatically piecing up a yarn in an open-end spinning machine and an open-end spinning machine for carrying out the same, by which the above-mentioned defect can be eliminated and easy restarting of an open-end machine can be facilitated.

Another object of the present invention is to provide a method of automatically piecing up a yarn in an open-end spinning machine and open end spinning machine for carrying out the same, by which the traverse of the traverse guide is started after a pieced joint between an end of the yarn and a newly spun yarn reaches a contacting line formed between a winding drum and a cheese wound around a bobbin and is rotated by the winding drum so that the pieced joint is not exposed to an excessive tension caused by the traverse motion of the traverse guide.

The above-mentioned and further objects, as well as novel features, of the present invention will more fully apparent from the detailed description of the same, set forth below, with reference to the accompanying drawings. It is to be understood, however, that the drawings are for purposes of illustration only and are not intended as a definition of the limits of the invention.

DETAILED DESCRIPTION OF THE INVENTION

Figure 1:
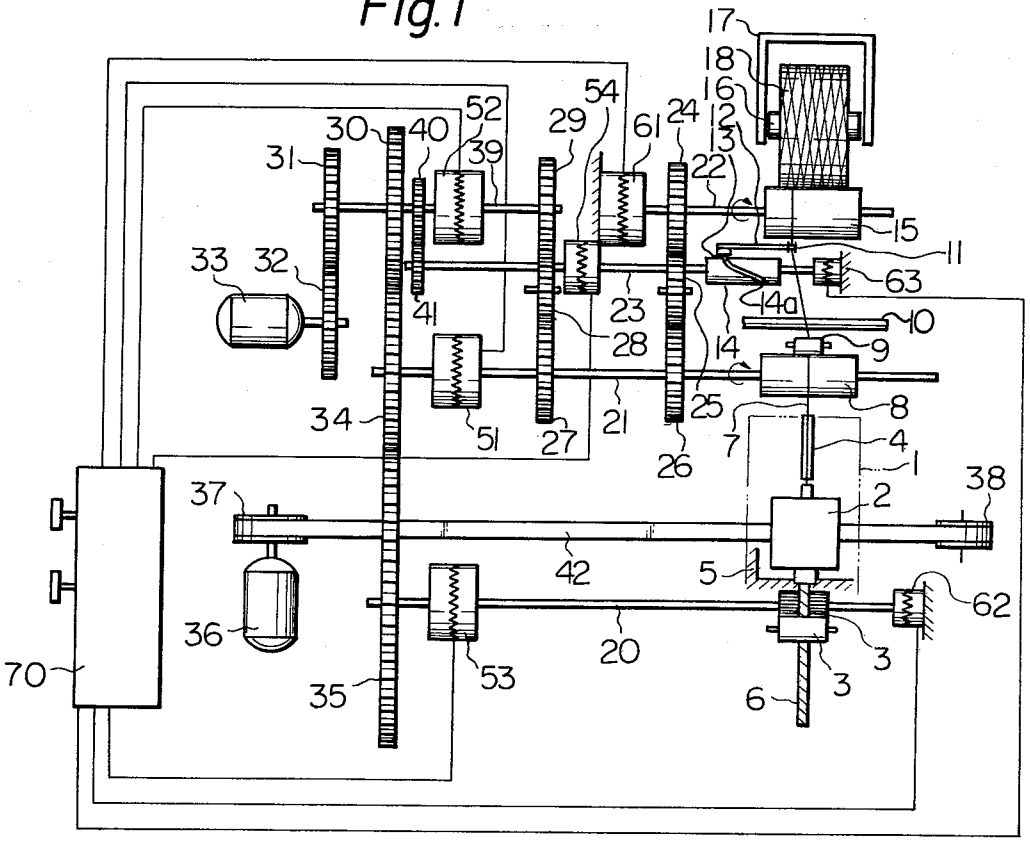
FIG. 1 is a schematic elevational view of an open-end spinning machine for carrying out the method of the present invention.

An open-end spinning machine, according to the present invention is explained hereinafter with reference to the accompanying drawings. Although the open-end spinning machine is usually provided with a plurality of spinning units, an open-end spinning machine which is provided with only one spinning unit, is shown in FIG. 1. Referring to FIG. 1, a spinning unit 1 comprises a spinning rotor 2 rotatably mounted on a frame 5, feed rollers 3 and a delivery tube 4. The feed rollers 3 are utilized for supplying fibers 6 to a combing roller (not shown). The combing roller is rotatably mounted within the spinning unit 1 so as to be rotated with the spinning unit 1, and is utilized for combing the supplied fibers 6 and for supplying said combed fibers 6 to the spinning rotor 2. The spinning rotor 2 collects the supplied fibers 6 into a yarn 7 and twists the yarn 7. A draw off roller 8, having a press roller 9 swingably mounted thereon, for withdrawing the yarn 6 from the spinning rotor 2 via the delivery tube 4, is provided at a position downstream of said delivery tube 4. A guide bar 10, for guiding the yarn 7, is disposed at a position between the draw off roller 8 and a traverse guide 11 disposed on a traverse rod 12. An end of the traverse rod 12 is provided with a pin 13 which slidably penetrates into a groove 14a formed on a surface of a groove roller 14. Consequently the traverse guide 11 is traversed to and fro when the groove roller 14 is rotated. A winding drum 15 is disposed at a position downstream of the traverse guide 11 and is utilized for frictionally rotating a bobbin 16, rotatably mounted on a pair of cradle arms 17, so that the yarn 7 is wound around the bobbin 16 and forms a cheese 18.

Figure 2:
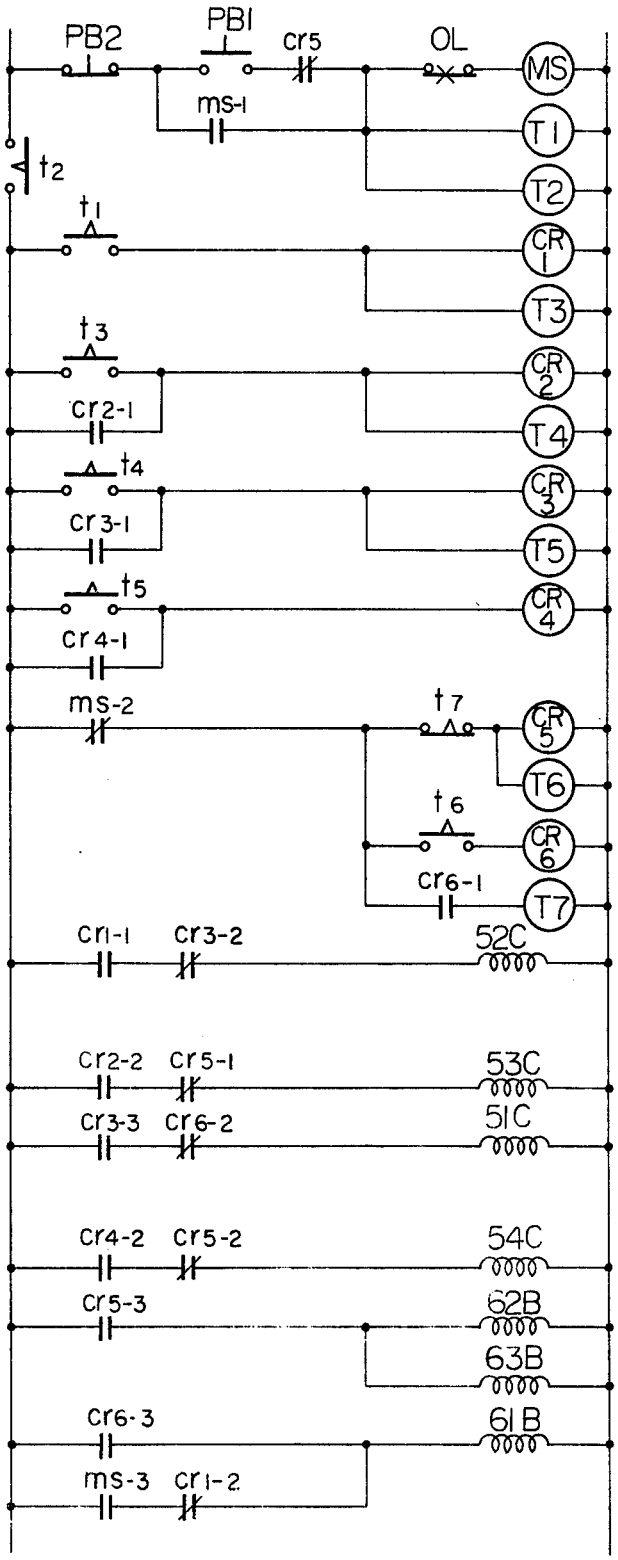
FIG. 2 is a wiring diagram utilized in the machine shown in FIG. 1.

Both a shaft 21 of the draw off roller 8 and a shaft 22 of the winding drum 15 are rotated in the same direction by way of the gear trains 24, 25 and 26. Each of the shafts 21 and 22 is rotatably supported by a bearing (not shown) which is fixed to the frame 5. The two shafts 21 and 22 are driven by an electric motor 33. Each shaft 21, 22 is driven in a normal rotating direction by the motor 33 by way of an electromagnetic clutch 51, which is mounted on the shaft 21. Each shaft 21, 22 is driven by the motor 33 in the reverse rotating direction by way of an electromagnetic clutch 52 which is mounted on a shaft 39. Gear trains 27, 28, 29, 30, 31, 32 and 34 are provided as driving gear trains, but the former gear trains 27, 28 and 29 are used only in case it is required to drive the shaft 21 in the reverse rotating direction. A shaft 20 of the feed roller 3 is driven by the gear 34 by way of a gear 35 and an electromagnetic clutch 53. The shaft 20 of the feed roller 3 and the shaft 22 of the winding drum 15 are provided with a magnetic brake 62 and a magnetic brake 61, respectively. The magnetic brakes 61 and 62 and electromagnetic clutches 51, 52 and 53 are controlled by an electric control circuit 70. An electric motor 36 drives the spinning rotor 2 by means of an endless belt 42 which is slidably bridged between a wheel 37, connected to the electric motor 36, and a wheel 38. It should be noted that the endless belt 42 also drives other spinning rotors which belong to respective open-end spinning units, however, other open-end spinning units are not shown in FIG. 1. A shaft 23 of the grooved roller 14, which extends behind the gears 24, 25, 26, 27, 28 and 29, is driven by the motor 33 by way of gear trains 31, 32, 40 and 41 and an electromagnetic clutch 54 mounted on the shaft 23. The shaft 23 of the grooved roller 14 is provided with a magnetic brake 63. The electromagnetic clutch 54 and the magnetic brake 63 are controlled by the electric control circuit 70. The electromagnetic clutches 51, 52, 53 and 54 and the magnetic brakes 61, 62 and 63 include exciting coils 51C, 52C, 53C, 54C, 61B, 62B and 63B (FIG. 2), respectively, for the driving thereof and these exciting coils are wired as shown in FIG. 2.

The electric circuit 70 for controlling the open-end spinning machine is hereinafter explained with reference to the accompanying FIG. 2. In FIG. 2, PB1 designates a push-button switch for starting the operation of the open-end spinning machine of the present invention. PB2 designates a push-button switch for stopping the operation of the open-end spinning machine. MS and ms-1 through ms-3 designate a solenoid coil of a relay and the contacts of the relay, respectively, for starting the main motor 33 (FIG. 1) mechanically connected to feed rollers 3, draw off roller 8, groove roller 14 and winding drum 15 via suitable power transmitting means such as gear trains, as shown in FIG. 1, and for starting the motor 36 connected to the spinning rotor 2. T1 through T7 and *t*1 through *t*7 designate time switches and the contacts thereof, respectively. CR1 through CR6 and cr1-1 through cr6-3 designate solenoid coils of relays and the contacts of the relays, respectively. OL designates a relay switch which operates when an overload current flows.

Figure 3:
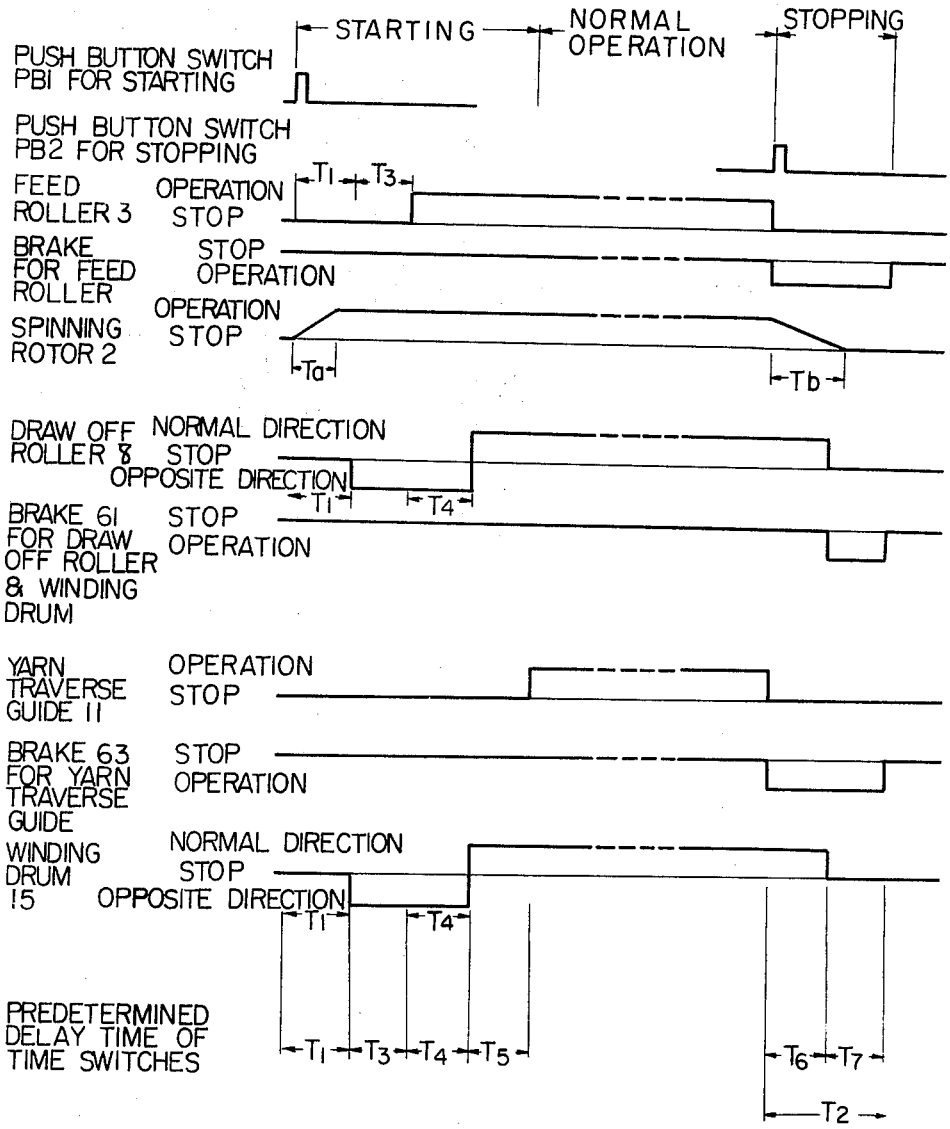
FIG. 3 is an operational diagram of the machine shown in FIG. 1.

The operation of the open-end spinning machine according to the present invention is hereinafter explained with reference to FIGS. 2 and 3.

A. Starting operation of the open-end spinning machine.

(1) When the push-button switch PB1 is pushed, the solenoid coil of the relay MS is excited and the circuits (not shown) of the main motor 33 and motor 36 (FIG. 1) are closed, whereby the main motor 33 and the motor 36 are started. As a result, the spinning rotor 2 and the combing roller (not shown), connected to the motor 36, are rotated up to a normal high speed after a start-up time $T_a$. Since the normal speed of the spinning rotor 2 is significantly higher than that of the other means, the long start-up delay time $T_a$ is generated by the inertia of the spinning rotors 2, while the spinning rotors 2 are sped up. Since the main motor 33 is disconnected from the feed roller 3, the draw off roller 8 and the winding drum 15 at the starting up thereof, the main motor 33 reaches its normal rotating speed in a very short time after the push-button switch PB1 is pushed. At the same time, the circuit comprising the push-button switch PB2, for stopping the open-end spinning machine, the contact ms-1 of the relay MS and the time switch T1, and the circuit comprising the push-button switch PB2, the contact ms-1 of the relay MS and the time switch T2, are closed. Then, the break contact *t*2 of the time switch T2 having a predetermined time delay $T_2$ is closed immediately. For a predetermined delay time $T_1$, which is adjusted to be slightly longer than the start-up time $T_a$, the time switch T1 is energized and is closed.

(2) When the contact *t*1 of the time switch T1 is closed, the solenoid coil of the relay CR1 is energized. Then, the contacts cr1-1 of the relay CR1 is closed and cr1-2 of the relay CR1 is opened and the time switch T3 is energized. Since the contact cr1-1 of the relay CR1 is closed, the circuit comprising the contact cr1-1, the break contact cr3-2 of the relay CR3 and the solenoid coil 52C, of the electromagnetic clutch 52 mounted on the shaft 39, is closed. Because the electromagnetic clutch 52 is connected to the winding drum 15 and the draw off roller 8 via gear trains 24, 25 and 26, for reversely rotating the winding drum 15 and the draw off roller 8, when the above-mentioned circuit including the solenoid coil 52 is closed, the winding drum 15 and the draw off roller 8 are rotated in a direction opposite to their normal rotating direction. As mentioned in item (1) above, when the push-button switch PB1 is pushed, the spinning rotor 2 is rotated. This causes the air pressure within the spinning rotor 2 to be decreased and the yarn 7 becomes slack due to the above-mentioned reverse rotation of the draw off roller 8. Therefore, an end of the yarn (not shown) situated in the delivery tube 4 is caused to move back into the spinning rotor 2 by the above-mentioned decreased air pressure.

(3) After the time switch T3 is energized for a predetermined delay time $T_3$, the make contact *t*3 of the time switch T3 is closed and the solenoid coil of the relay CR2 is energized. When the solenoid coil of the relay CR2 is energized, the circuit comprising the contact cr2-2 of the relay CR2, the break contact cr5-1 of the relay CR5 and the exciting coil 53C, for driving the clutch 53 connected to the feed roller 3, is closed. Then the feed roller 3 starts to rotate and fibers 6 begin to be supplied into the spinning rotor 2. As a result, the end of yarn and the supplied fibers are pieced up within the spinning rotor 2.

(4) When a predetermined delay time $T_4$ has passed after the close of the make contact *t*3 of the time switch T3 and after the time switch T4 is energized, the time switch T4 is closed and both the solenoid coil of the relay CR3 and time switch T5 are energized. When the solenoid coil of the relay CR3 is energized, the break contact cr3-2 opens and the exciting coils 52C become open. In addition, the circuit comprising the contact cr3-3 of the relay CR3, the break contact cr6-2 of the relay CR6 and the exciting coil 51C for driving the electromagnetic clutch 51, is closed. Then the winding drum 15 and the draw off roller 8 are rotated in their normal rotating direction.

The predetermined delay times $T_3$ and $T_4$ of the time switches T3 and T4 are suitably determined so that the above-mentioned piecing up operation can be carried out and the newly supplied fibers 6 collected in the spinning rotor 2 can be withdrawn from the spinning rotor 2 to the draw off roller 8 and press roller 9.

(5) For a predetermined time $T_5$, the time switch T5 is energized and, then, the time switch T5 is closed for exciting the solenoid coil of the relay CR4. Thereafter, the circuit comprising the contact cr4-2 of the relay CR4, the break contact cr5-2 of the relay CR5 and the exciting coil 54C for driving the clutch 54 is closed. As a result, the groove roller 14 connected to the clutch 54, starts to rotate in its normal rotating direction. Consequently, the traverse guide 11 is traversed to and fro via the groove roller 14.

The predetermined delay time $T_5$ of the time switch T5 is adjusted to a suitable time so that the traverse of the traverse guide 11 is commenced after the pieced joint between the end of the yarn and the newly spun yarn reaches the contacting line A. The line A is formed between the winding drum 15 and the cheese 18 wound around the bobbin 16. The adjustment of the delay time $T_5$ is based on the yarn path length between the spinning rotor 2 and the cheese 18 and the winding drum 15 yarn winding speed.

The open-end spinning machine according to the present invention is started and enters into a normal operation as described above.

B. Stopping operation of the open-end spinning machine.

(1) When the push-button switch PB2 is pushed, the operation of the solenoid coil of the relay MS for operating the main motor 33 and the motor 36 (FIG. 1) is stopped. Then the main motor 33 is turned off. However, the main motor 33 is at this time connected to the feed roller 3, draw off roller 8 and the winding drum 15, and has a large inertia, and, consequently, the main motor 33 continues its rotation for a while. In addition, when the relay MS is stopped, the motor 36 is turned off and is brought to a standstill after a certain delay time $T_b$. The delay time $T_b$ is generated by the inertia of the spinning rotors 2. The fiber supply, however, is stopped, when the feed roller 3 is stopped, before the spinning rotor 2 is stopped. At the same time, the time switch T2 is energized.

(2) When the solenoid coil of the relay MS is open, the circuit comprising the break contact ms-2, break contact t7 of the time switch T7, having a predetermined delay time $T_7$, and either the solenoid coil of the relay CR5 or the time switch T6 is closed. Then the solenoid coil of the relay CR5 is energized and the time switch T6 is energized.

(3) When the solenoid coil of the relay CR5 is energized, both the circuit comprising the contact cr2-2 of the relay CR2, the break contact cr5-1 of the relay CR5 and the exciting coil 53C for driving the clutch 53, and the circuit comprising the contact cr4-2 of the relay CR4, the break contact cr5-2 of the relay CR5 and the exciting coil 54C for driving the clutch 54 are opened. Then, the driving of the electromagnetic clutch 53 connected to the feed roller 3 and the electromagnetic clutch 54 connected to the groove roller 14, with which the traverse guide 11 is engaged, is stopped. At the same time, the circuit comprising the contact cr5-3 and either the exciting coil 62B, for driving the brake 62 connected to the feed roller 3, or the exciting coil 63B, for driving the brake 63 connected to the groove roller 14 with which the traverse guide 11 is engaged, is closed. Then the feed roller 3 and the traverse guide 11 are braked and brought to a standstill.

(4) When the predetermined time $T_6$ has passed after the time switch T6 is energized, the time switch T6 is closed and the circuit comprising the contact ms-2 of the relay MS, the contact t6 of the time switch T6 and the solenoid coil of the relay CR6, is closed, then the solenoid coil of the relay CR6 is energized and the contact cr6-1 is closed so that the time switch T7 is energized.

(5) When the solenoid coil of the relay CR6 is energized, the circuit comprising contact cr3-3 of the relay CR3, the break contact cr6-2 of the relay CR6 and the exciting coil 51C for driving the electromagnetic clutch 51 is opened. Therefore, the electromagnetic clutch 51 connected to the winding drum and the draw off roller 7 becomes open. At the same time, the circuit comprising contact cr6-3 and the exciting coil 61B for driving the magnetic brake 61, is closed, Then, the magnetic brake 61 connected to the winding drum 15 and draw off roller 8 becomes engaged and both the winding drum 15 and the draw off roller 8 are brought to a standstill, while the main motor 33 continues its rotation due to its inertia.

In this case, it is necessary that the delay time $T_6$ of the time switch T6 be adjusted so that it is suitable for the maintaining of the end of the yarn within the delivery tube 4.

(6) When the time switch T7 is energized for the predetermined time $T_7$, the time switch T7 is closed and the solenoid coils of the relays CR5 and CR6, wired to the break contact *t7*, become open. Then the exciting coils 62B, 63B and 61B for driving the magnetic brakes 61, 62 and 63, respectively, become open. The delay time $T_7$ of the time switch T7 is adjusted so that the time switch can be closed after the winding drum 15 and the draw off roller 8 are brought to a complete standstill.

(7) When the predetermined time $T_2$ is passed after the push-button switch PB2 is pushed, the time switch T2 is closed. Then the break contact *t2* of the time switch T2 is opened and, at that time, all of the holding circuits are open.

During the automatic piecing up operation of the machine, the traverse of the traverse guide is commenced after the pieced joint reaches a contacting line formed between the winding drum and the cheese and is wound on the cheese. As a result the pieced joint can be free from excessive yarn tension generated in the yarn caused by the traverse motion. Therefore, the number of yarn breakages occuring during starting operation can be decreased and the rate of success of automatic piecing can be high.

The method according to the present invention can also be applied to an open-end spinning machine in which a yarn situated between the spinning rotor or the delivery tube and the draw off roller is moved in a direction perpendicular to the normal yarn path by way of a yarn path bending guide means at the time a signal for a machine stop is actuated and the yarn is reserved along a bent yarn path. When the machine is started, the guide means is moved back and the yarn becomes free from the guide means. Consequently, the end of the yarn is moved back into the spinning rotor and is pieced up.

What is claimed is:

1. A method of automatically piecing up a yarn in an open-end spinning machine comprising feed rollers for supplying fibers to a combing roller so as to comb the fibers, a spinning rotor for collecting said combed fibers into a yarn and for twisting said yarn, a pair of draw off roller means for withdrawing said yarn from said spinning rotor, a delivery tube disposed at a position between said spinning rotor and said draw off roller means, a traverse guide for traversing said withdrawn yarn along a bobbin supported by cradle means, and a winding drum for frictionally driving said bobbin by engaging said bobbin along a line of contact therebetween to wind said yarn around said bobbin and form a cheese, said method comprising:

a first step of rotating both said draw off roller means and said winding drum in a direction opposite to their normal rotating directions;

a second step of rotating said feed rollers according to a predetermined program so that the said feed rollers begin to rotate after an end of the yarn is moved back into said spinning rotor where said moved back yarn is pieced up with the newly spun yarn;

a third step of rotating both said draw off roller means and said winding drum in their normal rotating direction, and;

a fourth step of starting the traverse motion of said traverse guide after the pieced joint between said end of the yarn and said newly spun yarn reaches the line of contact between said winding drum and said cheese wound around said bobbin.

2. An open-end spinning machine comprising:

feed rollers for supplying fibers to a combing roller so as to comb said fibers;

a spinning rotor for collecting said combed fibers into a yarn and for twisting said yarn;

a delivery tube disposed at a position upstream of said spinning rotor;

a pair of draw off roller means for withdrawing said yarn from said spinning rotor, said draw off roller means being disposed so as to be rotatable in both normal and opposite rotating directions;

a traverse guide for traversing said yarn along a bobbin;

a winding drum for rotating said bobbin by engaging said bobbin along a line of contact therebetween to wind said yarn around said bobbin and form a cheese, said winding drum being disposed so as to be rotatable in both normal and opposite rotating directions; and controlling means, for controlling said feed rollers, said spinning rotor, said pair of draw off roller means, said traverse guide and said winding drum according to a predetermined program, the traverse of said traverse guide being started after a pieced joint between an end of said yarn and a newly spun yarn reaches the line of contact between said winding drum and said cheese wound around said bobbin.

3. An open-end spinning machine according to claim 2, wherein said draw off roller means and said winding drum are connected together by way of transmission means, said transmission means being engageable with a main power source by way of one of two clutch means, so that said draw off roller means and said winding drum are rotatable in both a normal rotating direction and an opposite rotating direction, and said traverse guide is engageable with said main power source by way of another clutch means.

4. An open-end spinning machine according to claim 3, wherein said controlling means comprises a time switch T5, having a particular predetermined delay time $T_5$, which is energized when one of said clutch means connected to said draw off roller means and winding drum is engaged so as to rotate said draw off roller means and winding drum in a normal rotating direction thereof, and a relay CR4 which is energized when a contact of said time switch T5 is closed after said time switch is energized for said particular predetermined delay time $T_5$ so as to begin the traverse said traverse guide.

5. An open-end spinning machine according to claim 4, wherein said particular predetermind delay time $T_5$ of said time switch T5 is adjusted to a suitable time so that the traverse of the traverse guide is commenced after said pieced joint reaches said contacting line.

* * * * *

UNITED STATES PATENT OFFICE

CERTIFICATE OF CORRECTION

Patent No. 4,100,722 Dated July 18, 1978

Inventor(s) Osamu Suzuki, et al

It is certified that error appears in the above-identified patent and that said Letters Patent are hereby corrected as shown below:

Column 2, line 4: After "will" insert --be--.

Column 8, line 32: Before "said" insert --of--.

line 35: "predetermind" should be --predetermined--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*